US005213478A

United States Patent [19]

Hoya

[11] Patent Number: 5,213,478

[45] Date of Patent: May 25, 1993

[54] SLURRY PUMPING METHOD AND APPARATUS

[76] Inventor: Takeshi Hoya, 851-1, Oaza Noda, Irumi-shi, Japan

[21] Appl. No.: 811,930

[22] Filed: Dec. 23, 1991

Related U.S. Application Data

[63] Continuation-in-part of Ser. No. 630,736, Dec. 20, 1990, abandoned, which is a continuation of Ser. No. 408,348, Sep. 18, 1989, abandoned.

[51] Int. Cl.[5] ..... F04B 15/02

[52] U.S. Cl. ..... 417/53; 417/342; 417/344; 417/394; 417/900

[58] Field of Search ..... 417/342, 344, 345, 346, 417/347, 383, 394, 900, 53

[56] References Cited

U.S. PATENT DOCUMENTS

| | | | |
|---|---|---|---|
| 2,703,055 | 3/1955 | Veth et al. | 417/345 X |
| 4,304,527 | 12/1981 | Jewell et al. | 417/900 X |
| 4,439,112 | 3/1984 | Kitsnik | 417/383 |
| 4,490,096 | 12/1984 | Box | 417/342 |
| 4,543,044 | 9/1985 | Simmons | 417/342 |
| 4,604,037 | 8/1986 | Hoya | 417/394 |

*Primary Examiner*—Gerald A. Michalsky
*Attorney, Agent, or Firm*—Browdy and Neimark

[57] ABSTRACT

A slurry pumping method and an apparatus to deliver slurry waste from factories to a filter press for solid-liquid separation. In this apparatus, a pair of laterally or vertically arranged diaphragm type pumping devices are activated by hydraulic cylinders, each consisting of a main cylinder and a subcylinder directly connected to the main cylinder, to introduce slurry from the slurry tank and deliver it under pressure by a resilient diaphragm of each pumping device to the filter press where it is processed for solid-liquid separation. One of the diaphragm type pumping devices is first started, followed by the other, thus alternately and repetitively activating the two pumping devices to achieve continuous operation of the slurry pumping process. When the processing is completed, the two hydraulic cylinders of both diaphragm type pumping devices are stopped by controlling the sleeve valves. In this way, an effective slurry pumping can be achieved.

4 Claims, 6 Drawing Sheets

SLURRY PUMPING METHOD AND APPARATUS

1. FIELD OF THE INVENTION

The invention relates to a method of affecting solid-liquid separation using slurry pumping apparatus, and is a continuation-in-part of U.S. patent application Ser. No. 07/630,736, filed Dec. 20, 1990, now abandoned, which was a continuation of U.S. patent application Ser. No. 07/408,348, filed Sep. 18, 1989, now abandoned and which are incorporated by reference in their entirety. More particularly, the invention relates to a method and apparatus for separating factory wastes, agricultural wastes or stock forming wastes into solid and liquid slurries.

2. DESCRIPTION OF THE PRIOR ART

The advance and innovation of science and technology have brought about drastic improvements in the standard of living and a corresponding growth of manufacturing industries. The flourishing manufacturing industries in turn have caused environmental pollution to an extent that cannot be overlooked. Environmental destruction is steadily progressing, polluting air, rivers, and sea water. It is therefore necessary to establish a technology to check and diminish environmental pollution.

The conventional practice to dispose of noxious metals and wastes in a slurry state produced by heavy chemical and construction industries and by agricultural land stock farming industries consists of directly discharging these wastes into rivers and sea, or burning them for use with land reclamation. This method, however, causes environmental pollution through natural water systems. To cope with this problem, some measures have been developed. For example, a solid-liquid separation technique used in slurry pumping apparatus, a previous invention of the present inventor, employs a filter press to reduce the slurry into solid form with a very low water content. The dehydrated wastes are then mixed with concrete to be solidified and used as construction materials, or they are buried deep underground.

However, as mentioned above, the improved way of life has accelerated the growth of various manufacturing activities, producing a tremendous amount of slurry wastes over the years. To meet the pressing demand for disposing of an increasing amount of slurry waste, a number of expensive solid-liquid separation facilities need to be installed to meet the demand. Furthermore, the equipment used in the facilities should be made as small as possible.

Under these circumstances, there are growing demands for the development of a slurry solid-liquid separation technology with low initial and running costs which requires little maintenance service and can be relied upon to perform continuous processing.

SUMMARY OF THE INVENTION

An object of the present invention is to overcome deficiencies in the prior art, such as indicated above.

Another object of this invention is to provide a slurry pumping method and equipment that solves various problems associated with conventional slurry solid-liquid separation processing.

A further object is to provide a slurry pumping method and equipment which makes use of features of the already developed slurry processing technology and which is inexpensive and can be relied upon to perform continuous operation.

Still another object is to provide a slurry pumping method and equipment which has good durability, long life, and high reliability and which can be applied to various industries as anti-pollution technology.

In general, the slurry-pumping apparatus used to accomplish the objectives of the invention comprises:

a pair of resilient protruding diaphragm pumping devices having two hydraulic cylinders which are capable of being alternately and repetitively activated by a controller to deliver slurry from a tank into a press and in which the hydraulic cylinders of the pumping devices are in communication with each other through a hydraulic passage in which an open-close valve is connected electrically to a controller is installed;

means for starting one of the hydraulic cylinders of one pumping device by opening a valve;

means for starting another of the hydraulic cylinders at a down stroke end of said one hydraulic cylinder; and means for alternating the operating of the hydraulic cylinders continuously to deliver slurry to the filter press; wherein the two hydraulic cylinders each comprise: a main cylinder and a piston and a sub-cylinder and a piston, wherein the pistons are interconnected by a single rod so that the interconnected pistons can perform a reciprocating motion as one piece, and wherein area differences between pistons of the sub-cylinders and the main cylinders provide a large delivery force to the resilient protruding diaphragms to ensure continuous delivery of slurry to the said filter press.

Since large pistons are forced directly inside of resilient protruding diaphragms of lesser diameters than said large pistons, a large delivery force is provided to the diaphragms, thereby ensuring a continuous delivery of slurry to the filter press.

BRIEF DESCRIPTION OF THE DRAWINGS

The above and other objects and the nature and advantages of this invention will be more fully understood with reference to certain specific embodiments illustrated in the accompanying drawings in which.

DETAILED DESCRIPTION OF THE PREFERRED EMBODIMENTS

Figure 1:
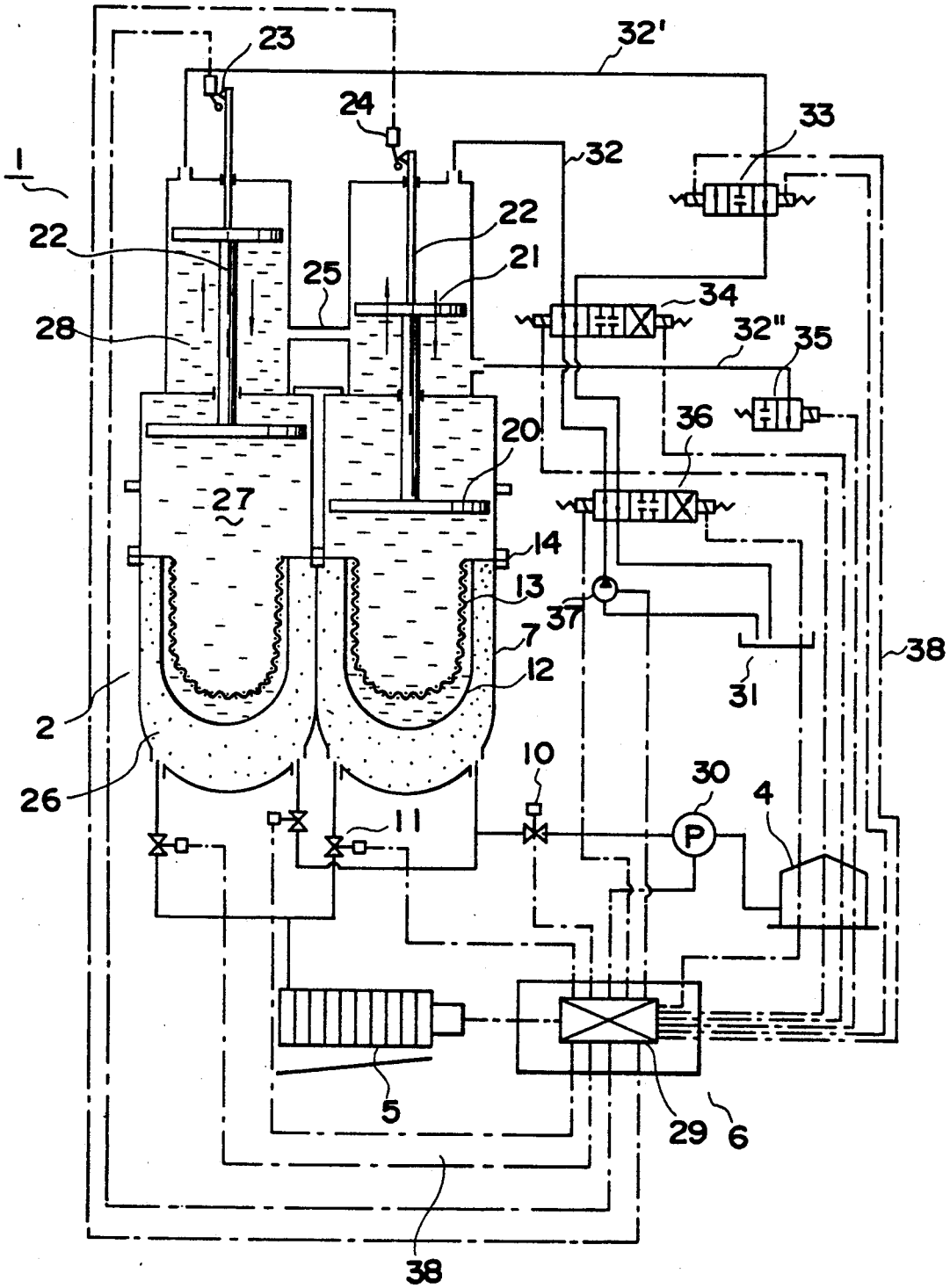
FIG. 1 is a schematic diagram showing the overall system of a first embodiment.

In the embodiment shown in FIGS. 1 to 7, a slurry pumping system 1 forms the core of the invention. The hardware of this system is a slurry pumping apparatus 2, shown in more detail in FIG. 7, which has a pair of diaphragm type pumping devices 3, 3 arranged side-by-side. As shown in FIG. 1, the slurry pumping apparatus 2 is connected, through piping, between a slurry tank 4 and a solid-liquid separation filter press 5. A controller 6 starts one of the two pumping devices 3 and alternates their operation. Any one of them can be chosen for operation and it is also possible to automatically stop both of them.

Figure 7:
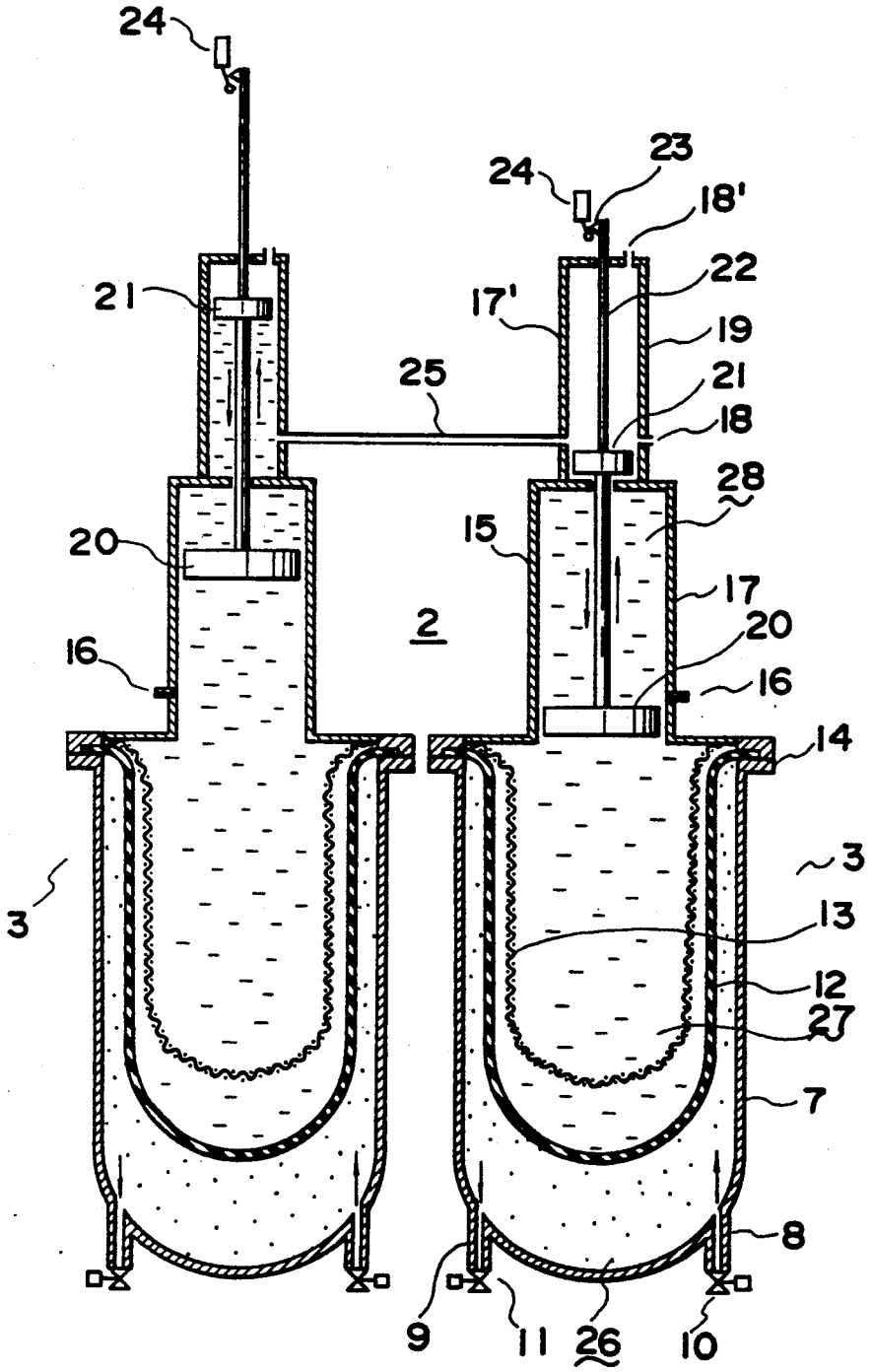
FIG. 7 is a cross-section of a slurry pumping apparatus.

The construction of each slurry pumping device 3 is 15 shown in FIG. 7. There is a casing 7, U-shaped in vertical cross-section, at the lower part of the pumping device 3. The casing 7 has supply and discharge ports 8, 9 connected to the slurry tank 4 and the filter press 5. In the piping connected to these ports are installed electromagnetic open-close valves 10, 11 which are electrically connected to the controller 6.

Inside the casing 7 there is provided a protruding type resilient diaphragm 12 made of rubber with a certain thickness which is U-shaped in vertical cross-section like the casing 7. The diaphragm 12 is interposed between the casing 7 and a porous support 13 which has a certain mesh and is also U-shaped in vertical cross-section. The resilient diaphragm 12 can be expanded and contracted and has its base securely clamped by a flange 14 at the upper part of the casing 7. The resilient diaphragm 12 is expanded until it contacts the inner surface of the casing 7 and is contracted until it contracts the support 13. The resilient diaphragm 12, as it expands and contracts, introduces slurry from the slurry tank 4 into the space between the casing 7 and the resilient diaphragm 12, and at the same time delivers the slurry out into the filter press 5. When it contracts, the resilient diaphragm 12 comes into contact with the support 13 so that it is not folded, preventing the repetitive formation of wrinkles or folded lines and potential break of the resilient diaphragm 12 through fatigue.

It is possible to change the support 13 from the porous 5 plate type to a metal type or to a flexible sleeve type. Various other designs may be employed, which are disclosed in many previous inventions of this inventor.

A main cylinder 15 is formed integral with and mounted on the top of the casing 7. Securely mounted on the casing 17 of the main cylinder 15 is a casing 17' of a sub-cylinder 19 which has working oil supply and discharge ports 18, 18'. Inside the casings 17, 17' of the main cylinder 15 and sub-cylinder 19 are installed working pistons 20, 21 that are interconnected by a single rod 22 so that the two pistons can perform a reciprocating motion as one piece. The upper end of the rod 22 that passes through the top of the sub-cylinder 19 is attached with a dog 23, which is engaged with or disengaged from a limit switch 24 electrically connected to the controller 6 to send a stroke end detection signal to the controller 6.

The two sub-cylinders 19, 19 of both slurry pumping devices 3, 3 communicate with each other through a hydraulic passage 25 that interconnects the base portions of the sub-cylinders 19, 19 at a point immediately above the down stroke end of the piston 21.

There is slurry 26 between the casing 7 and the resilient diaphragm 12 in each slurry pumping device 3, the slurry being supplied into the casing 7 from the slurry tank 4 and delivered to the filter press 5. Working oil 27 is sealed between the resilient diaphragm 12 and the piston 20 of the main cylinder 15. Lubricating and working oil 28 is sealed between the casing 17 and the piston 20 of the main cylinder 15 and between the casing 17' and the piston 21 of the sub-cylinder 19.

It is to be emphasized, by reference to FIG. 1, that the very large delivery force is created by two hydraulic cylinders, each of which comprises: a main cylinder and a large piston 20 and a sub-cylinder and a small piston 21, wherein pistons 20 and 21 are interconnected by a single rod 22 so that interconnected pistons 20 and 21 can perform a reciprocating motion as one piece, and wherein pistons 21 and 20 of said sub-cylinders and said main cylinders provide a large delivery force to resilient protruding diaphragms 12 to ensure continuous delivery of slurry to the filter press. The double piston connected single rod is such that the large diameter of big pistons 20 are forced directly to the inside of a protruding diaphragm.

In this connection, it will be noted that large pistons 20 are substantially larger than resilient protruding diaphragms 12 and this permits pistons 20 to be forced directly inside of protruding diaphragms to provide a large delivery force.

As is further shown in FIG. 1, the relay equipment 29 in the controller 6 is electrically connected with: the delivery pump 30 to supply slurry 26 from the slurry tank 4; electromagnetic open-close valves 10, 11 connected to the supply and discharge port 8, 9; sleeve valves 33, 34, 35, 36 connected through hydraulic passages 32, 32', 32'' to the oil tank 31; and the oil pump 37 through cable 38 to send control signals to the pump 37.

Figure 2:
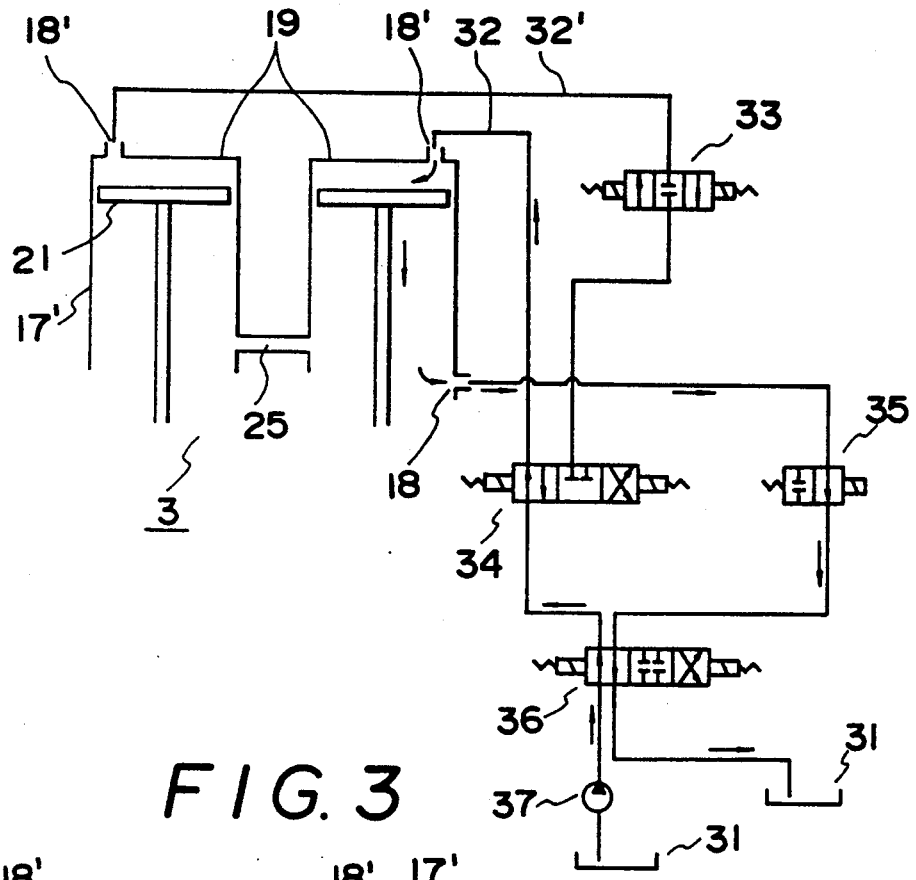
FIGS. 2 to 6 are schematic diagrams showing the sequence of continuous operation from starting to stopping.

In the above configuration, the method of pumping the 5 slurry 26 from the slurry tank 4 into the filter press 5 through the slurry pumping devices 3, 3 will be explained. When the slurry pumping device 3 is at rest, i.e. when the slurry 26 is not being pumped from the slurry tank 4 into the filter press 5 as shown in FIG. 2, the pistons, 21, 21 of the sub-cylinders 19, 19 are both at the upper dead point. At this time the pistons 20, 20 of the main cylinders 15, 15 are also at the upper end of the stroke. When a start button (not shown) on the controller 6 is pressed, the sleeve valves 33, 34, 35, 36 are activated into positions as shown in FIG. 2. As a result, the working oil is delivered by the oil pump 37 from the oil tank 31 through sleeve valve 36 and sleeve valve 34 into the port 18' of the right-hand side sub-cylinder 19, pushing the piston 21 downwardly. This in turn causes the oil in the right-hand side sub-cylinder 19 to be discharged from the lower port 18 and returned through sleeve valve 35 and sleeve valve 36 to the oil tank 31.

Figure 3:
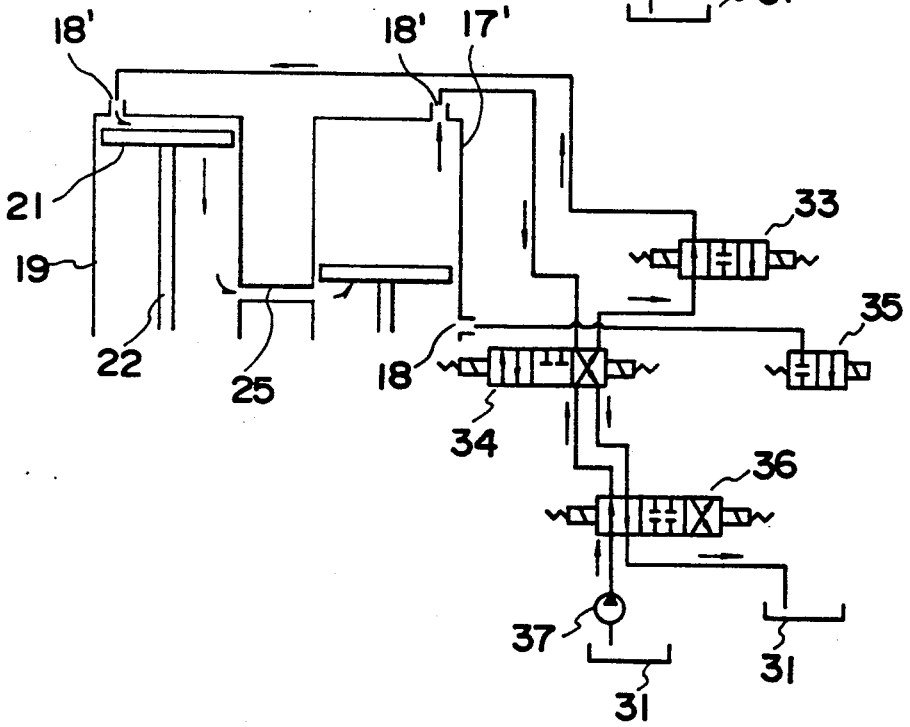

As the piston 21 of the right-hand side sub-cylinder 19 reaches the lower dead point immediately above the hydraulic passage 25, the dog 23 of the rod 22 turns on the limit switch 24, operating the relay equipment 29 of the controller 6 to activate the sleeve valves 33, 34, 35, 36 to the positions shown in FIG. 3. With the sleeve valves 33, 34, 35, 36 operated, the working oil from the oil tank 31 is delivered from the hydraulic pump 37, through sleeve valves 36 and 34 to the upper port 18' of the left-hand side sub-cylinder 19. On the other hand, the oil in the right-hand side sub-cylinder 19 is returned from the upper port 18' to the oil tank 31 through the hydraulic passage 32 and sleeve valves 34 and 36. The right and left sub-cylinders 19, 19 are interconnected through the hydraulic passage 25, so that the working oil in the left-hand side sub-cylinder 19 moves through the hydraulic passage 25 into the right-hand side sub-cylinder 19, applying pressure to the underside of the piston rod 22 of the right sub-cylinder 19 to start the slurry pumping device 3.

At the initial stage of the operation, the piston 21 of the right sub-cylinder 19 is pushed down by the working oil introduced from the upper port 18', as shown in FIG. 2. The lower port 18 of the right sub-cylinder 19 is connected to the sleeve valve 35, returning the oil through the sleeve valve 36 to the oil tank 31. The upper port 18' of the left sub-cylinder is blocked by the sleeve valve 33, so that oil passage 25 is also blocked. Therefore, the pressurized working oil under the piston 21 of the right sub-cylinder 19 does not apply pressure to the underside of the piston 21 of the left sub-cylinder 19.

Figure 4:
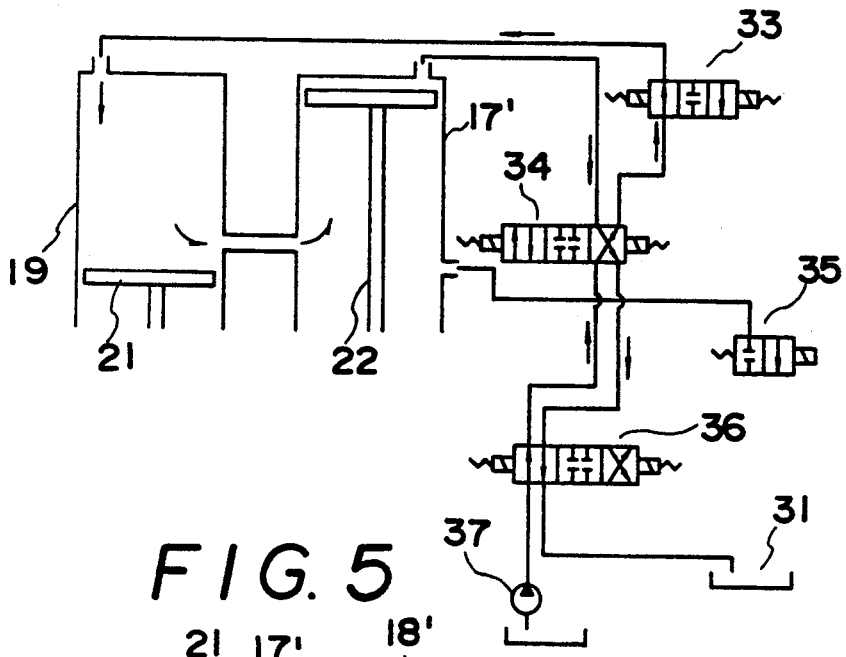
Figure 5:
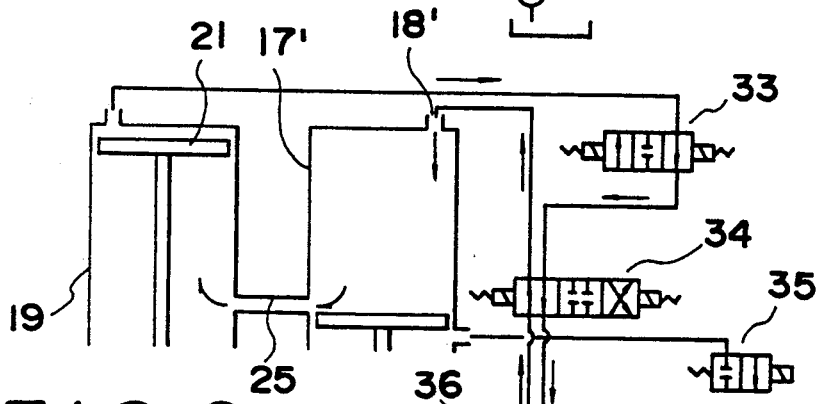

As the operation proceeds, reaching the condition of FIG. 3, the sleeve valves 33, 34, 35, 36 are switched as shown in FIG. 3, with the result that the lower port 18 of the right sub-cylinder 19 is blocked by the sleeve valve 35 and that the upper port 18' of the left sub-cylinder 19 is pressurized through sleeve valves 33, 34 and 36. The hydraulic passage 25 communicates with the left and right sub-cylinders 19, 19, so that the pressing action of one piston 21 applies pressure to the other piston 21, operating the limit switch 24 through the engagement or disengagement of the dog 23 of each rod 22 at the stroke end. The limit switch 24 in turn drives the relay equipment 29 of the controller 6 operating the sleeve valves 33, 34, 35, 36 as shown in FIG. 4. This automatically switches each sub-cylinder 19 into the active or passive pressure condition when the piston 21 reaches the end of its stroke. When the sleeve valves 33, 34, 35, 36 are operated, as shown in FIG. 5, the pistons 21, 21 of the left and right sub-cylinders 19, 19 switch between the active and the passive pressure conditions at the upper dead point and the lower dead point, i.e. at the up stroke end and down stroke end. As a result, the pistons 20, 20 of the main cylinders 15, 15 are also moved up or down by the rods 22, continually repeating the reciprocal movement.

Through the vertical reciprocal motion of the piston 20 of the main cylinder 15 in each process, the working oil 27 sealed inside the resilient protruding diaphragm 12 installed in the casing 7 of the pumping device 3 is repetitively switched between the positive and the negative pressure condition to expand and contract the resilient diaphragm 12 through a specified stroke. At the same time, the limit switch 24 for the relay equipment 29 of the controller 6 is turned on or off by the dog 23 to operate the open-close valves 10, 11 and also the delivery pump 30. This causes the slurry 26 to be supplied from the slurry tank 4 into the casing 7 through the port 8 and discharged from the casing 7 through the port 9 and delivered under pressure into the large and thick filter press 5 where the slurry undergoes the solid-liquid separation process.

Figure 8:
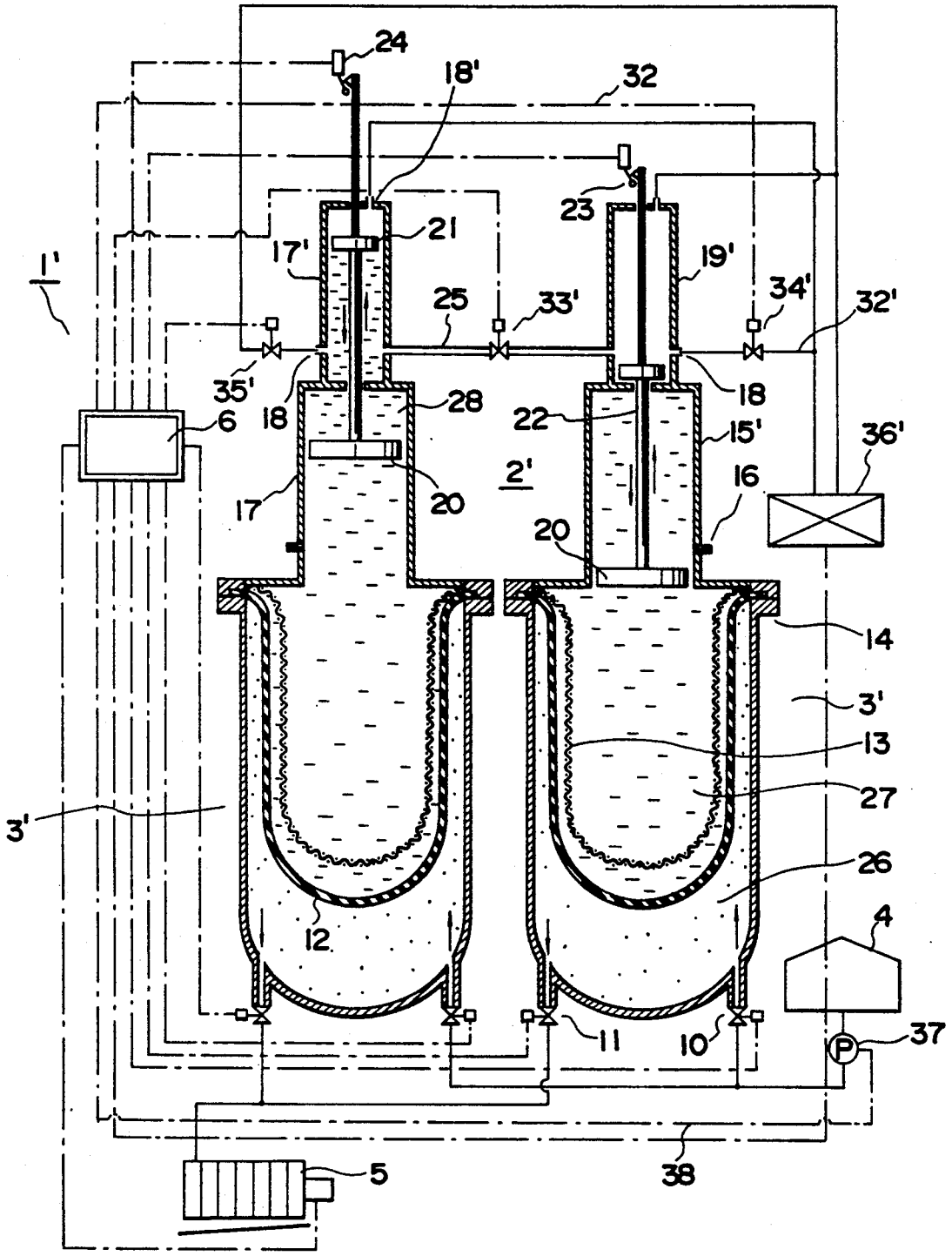
FIG. 8 is a schematic diagram showing the overall system of a second embodiment.

Then, as shown in FIGS. 7 and 8, because of the area difference between the pistons 21 and 20 of the sub-cylinder 19 and the main cylinder 15, a very large delivery force is applied to the resilient diaphragm 12, ensuring the continuous delivery of slurry 26 into the operating filter press 5.

Inside the resilient diaphragm 12 is installed the support 13 made of porous plate, as mentioned above, so that during the contracting process the resilient diaphragm 12 will be prevented from becoming smaller than the support 13. This ensures that no wrinkles will be formed on the interior or exterior surface of the resilient diaphragm 12, thus eliminating the possibility of fatigue fracture at the folded portions of the wrinkles. Therefore, the suction and delivery of slurry 26 can be reliably performed.

The working oil 28 between the main cylinder 15 and the sub-cylinder 19 serves as a kind of lubricating oil, eliminating friction and assuring smooth continuous reciprocating motions.

Figure 6:
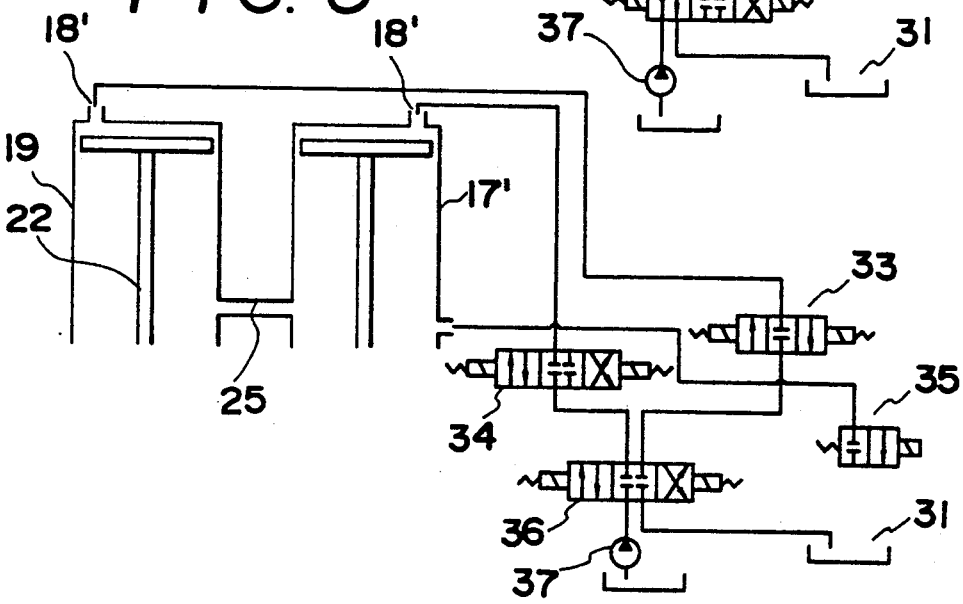

When the planned process has been completed or, during operation, if it is desired to stop the pumping device 3 for maintenance services on the resilient diaphragm, the stop button on the controller 6 is pressed. With the stop button pressed, the sleeve valves 33, 34, 35, 36 are switched as shown in FIG. 6, stopping the oil supply from discharging into the oil tank 31 through all ports 18, 18, 18', 18' and hydraulic passage 25, halting the sub-cylinders 19, 19 and therefore the slurry pumping system 1.

In the above embodiment, the supply and discharge of working oil between the sub-cylinder 19, 19 and the oil tank 31 are controlled by four sleeve valves 33, 34, 35, 36. Because the hydraulic passages in the sleeve valves are narrow, as shown in FIGS. 1 through 6, the flow resistance of the working oil is high, which may give rise to problems of reduced efficiency due to pressure loss.

To cope with this problem, another embodiment is provided as shown in FIG. 8. In this example, open-close valves 34' and 35' are installed in the hydraulic passage 32' between the valve unit 36' and the ports 18. The ports 18 are formed immediately above the stroke end of the piston 21 of the casing 17', 17' of the sub-cylinders 19', 19'. An open-close valve 33' is installed in the hydraulic passage 25 that communicates the two sub-cylinders 19', 19'. These valves 33', 34', 35' are hydraulically connected to the valve unit 36' which is controlled by the controller 6, in order to reduce the flow resistance of the working oil and thereby assure smooth flow of oil. In FIG. 8, the open-close valves 33', 35' are closed and the valve 34' is open. For the continuous operation, the valve unit 36' is controlled to close the valves 34', 35' and open the valve 33'. For automatic stopping, the valve unit 36' is controlled by the controller 6 to close the valves 33', 35' and open the valve 34'. The use of the valve unit 36' contributes to simpler and smoother valve operation and control.

Figure 9:
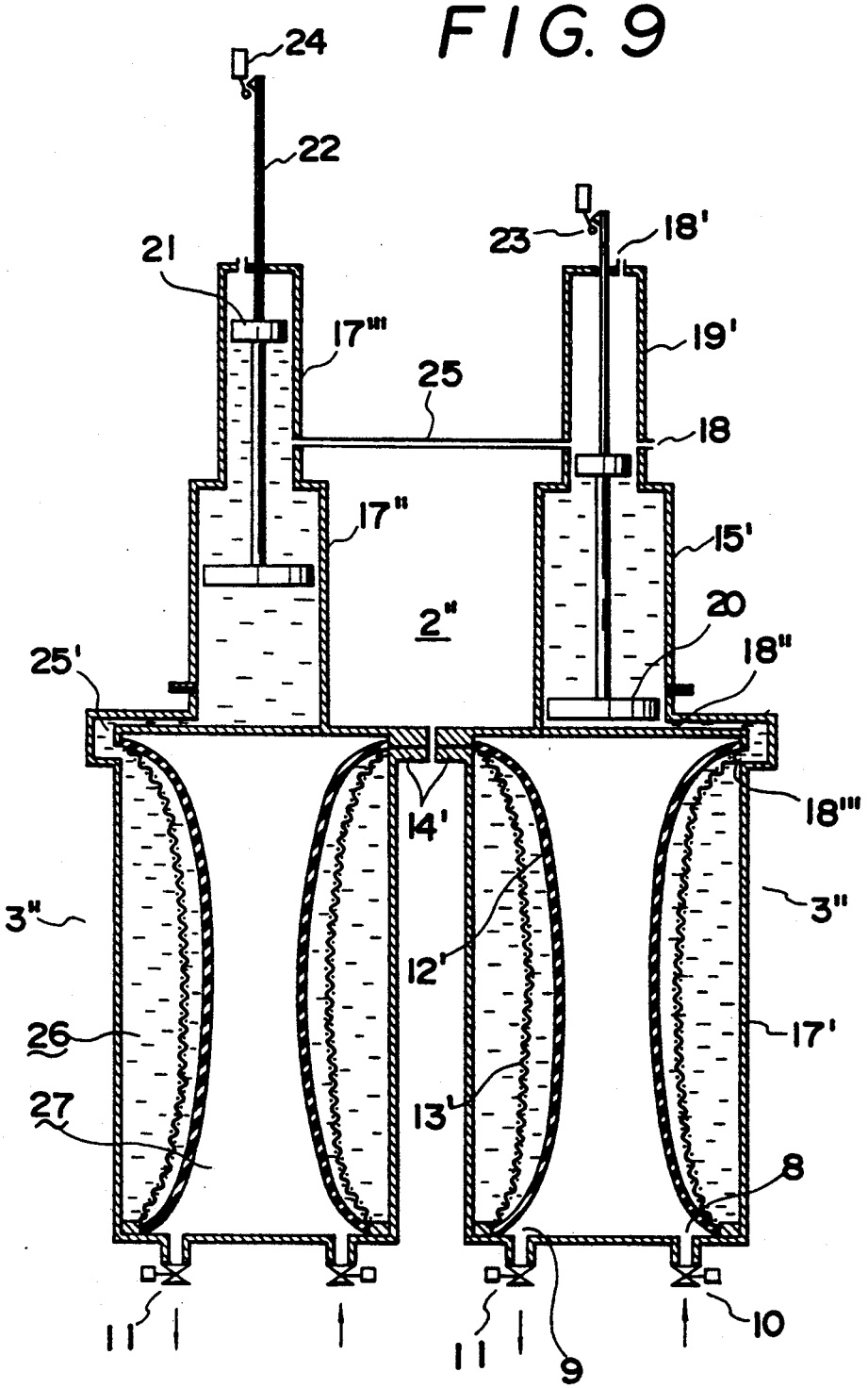
FIG. 9 is a cross-section of a third embodiment of slurry pumping apparatus.

Still another embodiment is shown in FIG. 9. In this example, the resilient diaphragm 12' installed in the casing 17' is shaped like a drum with a support 13' of a specified mesh interposed between the casing 17' and the diaphragm 12', while in the preceding embodiments of the pumping device 3 the resilient diaphragm 12 is of protruding type. The resilient diaphragm 12' is expandable in the radial direction of the casing 17' and therefore has smaller fatigue, assuring higher durability. With this construction, the pumping of the slurry 26 can be done reliably. A hydraulic passage 25' is formed between the port 18'' at the lower dead point of the piston 20 of the main cylinder 15' and the port 18''' at the upper portion of the casing 17'. This arrangement has virtually the same function and effect as the preceding embodiments.

The apparatus of this invention has the following advantages. During the process of delivering slurry from the slurry tank to the filter press by the diaphragm type pumping device, a very large delivery force can be obtained continuously so that the solid-liquid separation of slurry can be carried out continuously, instead of in batch form. Therefore, in the machinery manufacturing factories, agricultural and stock farming facilities, the slurry produced continuously in large quantity can reliably be processed to separate solid from liquid.

A pair of hydraulic cylinders of the diaphragm type pumping devices are communicated with each other through a hydraulic passage. One of the cylinders is first started, followed by the other, thus alternately activating the two cylinders. Since one cylinder can be started easily, it is possible to smoothly shift to the continuous alternating operation of the two cylinders.

Another advantage is that since the pair of diaphragm 20 type pumping devices are interconnected through a hydraulic passage, the pressure produced in one device in the active cycle is applied to the other device in the passive cycle, making the passive cycle device respond to the operation of the active cycle device. This in turn ensures smooth alternating operation of the paired diaphragm type pumping devices and therefore the reliable continuous delivery of slurry to the filter press.

By operating the sleeve valves and open-close valves by the controller, the hydraulic cylinders can be driven to continuously deliver slurry from the slurry tank into the filter press where it is processed for solid-liquid separation.

Furthermore, since either one of the pumping devices can be started easily if the first device to be started has previously stopped in the active or in the passive cycle, the system can be smoothly shifted into continuous operation.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of continuously delivering slurry from a slurry tank to a filter press comprising: providing slurry pumping apparatus comprising a pair of resilient protruding diaphragm 12 pumping devices having two hydraulic cylinders which are capable of being alternately and repetitively activated by a controller to deliver slurry from said tank into said press and in which said hydraulic cylinders of the pumping devices are in communication with each other through a hydraulic passage in which an open-close valve connected electrically to said controller is installed, starting one of the hydraulic cylinders of one pumping device by opening said valve;

starting another of said hydraulic cylinders at a down stroke end of said one hydraulic cylinder controlling said open-close valve; and alternating the operation of the hydraulic cylinders continuously to deliver slurry to said filter press; said two hydraulic cylinders each comprising: a main cylinder and a large diameter piston 20 and a sub-cylinder and a small diameter piston 21, wherein pistons 20 and 21 are interconnected by a single rod 22 so that interconnected pistons 20 and 21 can perform a reciprocating motion as one piece, and wherein area differences between small diameter pistons 21 and large diameter pistons 20 of said sub-cylinders and said main cylinders provide a large delivery force to said resilient protruding diaphragms 12 to ensure continuous delivery of slurry to the said filter press; and wherein said large diameter piston 20 is substantially larger in area than the diameter of resilient protruding diaphragm 12.

2. The slurry pumping method of claim 1, wherein said apparatus comprises sleeve valves installed in hydraulic circuits connected to oil supply and discharge ports of the hydraulic cylinders; said method further comprising controlling said sleeve valves.

3. The slurry pumping method of claim 2, comprising controlling the valves by limit switches operated by dogs attached to rods of the hydraulic cylinders.

4. The slurry pumping method of claim 1, comprising controlling the valves by limit switches operated by dogs attached to said rod of the hydraulic cylinders.

* * * * *